US007931044B2

(12) United States Patent
Lah et al.

(10) Patent No.: US 7,931,044 B2
(45) Date of Patent: Apr. 26, 2011

(54) VALVE BODY AND CONDENSATE HOLDING TANK FLUSHING SYSTEMS AND METHODS

(75) Inventors: Ruben F. Lah, West Jordan, UT (US); Gary Larsen, West Jordan, UT (US)

(73) Assignee: Curtiss-Wright Flow Control Corporation, Falls Church, VA (US)

( * ) Notice: Subject to any disclaimer, the term of this patent is extended or adjusted under 35 U.S.C. 154(b) by 910 days.

(21) Appl. No.: 11/682,592

(22) Filed: Mar. 6, 2007

(65) Prior Publication Data

US 2007/0251576 A1 Nov. 1, 2007

Related U.S. Application Data

(60) Provisional application No. 60/780,926, filed on Mar. 9, 2006.

(51) Int. Cl.
*F16T 1/00* (2006.01)

(52) U.S. Cl. ..... 137/15.06; 137/15.04; 137/241

(58) Field of Classification Search ..... 137/240, 137/1, 15.01, 15.04–15.06, 241, 238
See application file for complete search history.

(56) References Cited

U.S. PATENT DOCUMENTS

| | | | | |
|---|---|---|---|---|
| 176,321 | A | 4/1876 | Kromer | |
| 900,206 | A | 10/1908 | Reed | |
| 1,370,305 | A | 3/1921 | Golle | |
| 1,656,355 | A | 1/1928 | Huffmann | |
| 1,991,621 | A | 2/1935 | Noll | |
| 2,064,567 | A | 12/1936 | Riley | |
| 2,245,554 | A | 6/1941 | Court | |
| 2,317,566 | A | 4/1943 | Utterback | |
| 2,403,608 | A | 7/1946 | Payne | |
| 2,562,285 | A | 7/1951 | Timmer | |
| 2,575,464 | A | 11/1951 | Olsen | |
| 2,717,865 | A | 9/1955 | Kimberlin et al. | |
| 2,734,715 | A | 2/1956 | Knox | |
| 2,761,160 | A | 9/1956 | Manning | |
| 3,215,399 | A | 11/1965 | McInerney et al. | |
| 3,367,625 | A | 2/1968 | Fortune | |
| 3,379,623 | A | 4/1968 | Forsyth | |
| 3,617,480 | A | 11/1971 | Keel | |
| 3,646,947 | A | 3/1972 | Rochelle et al. | |
| 3,661,505 | A * | 5/1972 | Frolich | 137/241 |
| 3,716,310 | A | 2/1973 | Guenther | |
| 3,837,356 | A | 9/1974 | Selep et al. | |
| 3,852,047 | A | 12/1974 | Schlinger et al. | |
| 3,976,094 | A | 8/1976 | Jandrasi et al. | |

(Continued)

FOREIGN PATENT DOCUMENTS

JP 2000145989 5/2000

(Continued)

OTHER PUBLICATIONS

Zimmermann & Jansen, Through Conduit Type Valve Double Disc Design: Metal-to-Metal Seating, Brochure, Undated.

(Continued)

*Primary Examiner* — Kevin L Lee
(74) *Attorney, Agent, or Firm* — Kirton & McConkie; Michael F. Krieger

(57) ABSTRACT

The present invention relates to a valve body and condensate holding tank flushing system and method for use in a delayed coker operation.

41 Claims, 3 Drawing Sheets

U.S. PATENT DOCUMENTS 4,125,438 A 11/1978 Kelly et al.
4,174,728 A 11/1979 Usnick et al.
4,204,912 A * 5/1980 Schulte et al. ..... 201/29
4,253,487 A 3/1981 Worley et al.
4,275,842 A 6/1981 Purton et al.
4,335,733 A 6/1982 Richards
4,410,398 A 10/1983 Chipman et al.
RE31,439 E 11/1983 Rosensweig
4,492,103 A 1/1985 Naumann
4,513,590 A * 4/1985 Fine ..... 68/18 C
4,531,539 A 7/1985 Jandrasi et al.
4,611,613 A 9/1986 Kaplan
4,626,320 A 12/1986 Alworth et al.
4,666,585 A 5/1987 Figgins et al.
4,693,452 A 9/1987 Jandrasi
4,726,109 A 2/1988 Malsbury
4,738,399 A 4/1988 Adams
4,771,805 A 9/1988 Maa
4,797,197 A 1/1989 Mallari
4,820,384 A 4/1989 Pechacek
4,824,016 A 4/1989 Cody et al.
4,877,488 A 10/1989 Cody et al.
4,923,021 A 5/1990 Courmier et al.
4,929,339 A 5/1990 Elliot, Jr. et al.
4,959,126 A 9/1990 Tong et al.
4,960,358 A 10/1990 DiGiacomo et al.
4,973,386 A 11/1990 Callegari et al.
4,993,264 A 2/1991 Cody et al.
5,004,152 A 4/1991 Baker et al.
5,022,266 A 6/1991 Cody et al.
5,022,268 A 6/1991 Wolf et al.
5,024,730 A 6/1991 Colvert
5,035,221 A 7/1991 Martin
5,041,207 A 8/1991 Harrington et al.
5,048,876 A 9/1991 Wallskog
5,059,331 A 10/1991 Goyal
5,076,893 A 12/1991 Tong et al.
5,098,524 A 3/1992 Antalfy et al.
5,107,873 A 4/1992 Clinger
5,116,022 A 5/1992 Genreith et al.
5,221,019 A 6/1993 Pechacek et al.
5,222,307 A * 6/1993 Oba et al. ..... 34/417
5,228,525 A 7/1993 Denney et al.
5,228,825 A 7/1993 Fruchtbaum et al.
5,299,841 A 4/1994 Schaefer
5,417,811 A 5/1995 Malsbury
H1442 H 6/1995 Edgerton et al.
5,464,035 A 11/1995 Heinecke
5,500,094 A 3/1996 Fruchtbaum
5,581,864 A 12/1996 Rabet
5,633,462 A 5/1997 Heaslip et al.
5,652,145 A 7/1997 Cody et al.
5,785,843 A 7/1998 Antalffy et al.
5,794,729 A 8/1998 Van Meter et al.
5,800,680 A 9/1998 Guerra
5,816,505 A 10/1998 Tran et al.
5,816,787 A 10/1998 Brinkerohoff et al.
5,876,568 A 3/1999 Kindersley
5,907,491 A 5/1999 Canada et al.
5,927,684 A 7/1999 Marx et al.
5,947,674 A 9/1999 Malsbury et al.
5,974,887 A 11/1999 Cody et al.
6,007,068 A 12/1999 Dellacorte
6,039,844 A 3/2000 Malik
6,066,237 A 5/2000 Kindersley
6,113,745 A 9/2000 Maitland et al.
6,117,275 A * 9/2000 Baumann ..... 203/1
6,117,308 A 9/2000 Ganji
6,223,925 B1 5/2001 Malsbury et al.
6,228,225 B1 5/2001 Maher-Homji
6,254,733 B1 7/2001 Lu et al.
6,264,797 B1 7/2001 Schroeder et al.
6,264,829 B1 7/2001 Analffy et al.
6,288,225 B1 9/2001 Wakabayashi et al.
6,367,843 B1 4/2002 Fetzer
6,539,805 B2 4/2003 Heaslip et al.
6,547,250 B1 4/2003 Noble et al.
6,565,714 B2 5/2003 Lah
6,644,436 B2 11/2003 Hafmann et al.
6,644,567 B1 11/2003 Adams et al.
6,660,131 B2 12/2003 Lah
6,738,697 B2 5/2004 Breed
6,751,852 B2 6/2004 Malsbury et al.
6,843,889 B2 1/2005 Lah et al.
6,926,807 B2 8/2005 Bosi et al.
6,935,371 B2 8/2005 Stares
6,964,727 B2 11/2005 Lah
6,989,081 B2 1/2006 Lah
7,033,460 B2 4/2006 Lah
7,037,408 B2 5/2006 Wilborn et al.
7,115,190 B2 10/2006 Lah
7,117,959 B2 10/2006 Lah
7,316,762 B2 1/2008 Lah
2002/0134658 A1 9/2002 Lah
2002/0157897 A1 10/2002 Hofmann et al.
2002/0166862 A1 11/2002 Malsbury et al.
2002/0170814 A1 11/2002 Lah
2003/0047153 A1 3/2003 Kubel et al.
2003/0089589 A1 5/2003 Malsbury
2003/0127314 A1 7/2003 Bell et al.
2003/0159737 A1 8/2003 Stares
2003/0185718 A1 10/2003 Sellakumar
2004/0118746 A1 6/2004 Wilborn et al.
2004/0154913 A1 8/2004 Lah
2004/0238662 A1 12/2004 Paul
2005/0133358 A1 6/2005 Kersternich

FOREIGN PATENT DOCUMENTS

RU 2043604 C1 9/1995
RU 2163359 C1 2/2001
SU 558524 A 3/1984
SU 959413 A 3/1984
WO 0015985 3/2000

OTHER PUBLICATIONS

Zimmermann & Jansen, Through Conduit Type Valve Single Disc Design: Metal-to-Metal Seating, Brochure, Undated.
Z&J Technologies GMBH, Innovative Z&J Coker Isolation and Deheading Valves, PowerPoint Presentation.
Hazards of Delayed Coker Unit (DCU) Operations, Chemical Emergency Preparedness and Prevention Office, Aug. 2003, pp. 1-8.
Seminar Materials, "Delayed Coking Process Technology," presented by Refining Process Services, Inc. Apr. 20-22, 1999 in Houston, Texas, 89 pages.
Seminar Materials, "3rd Annual Universal Delayed Coking Seminar," held Oct. 26-28, 1998 in Santa Monica, California, 45 Pages.
Catalog: Velan Valve Corporation, 1980, 40 pages.
Enprosystems, html document, http://www.coking.com/Vendor/Enpro/Enpro.htm, accessed Feb. 27, 2006.
"DeltaValve News: Curtiss-Wright Acquires DeltaValve USA, LLC", News Release, (2 pages), http://261,239.53.104/search?q=cache:FB5fEGn3XkkJ:www.deltavalve.com/news/cw.html, accessed Oct. 8, 2003.
Ellis, Paul J.; Paul, Christopher A., "Tutorial: Delayed Coking Fundamentals", Great Lakes Carbon Corporation, Port Arthur, TX, Mar. 9, 1998, 20 pages.
Hazards of Delayed Coker Unit (DCU) Operations, Chemical Emergency Preparedness and Prevention Office, Aug. 2003, pp. 1-8.
U.S. Appl. No. 10/731,874, Non-Final Rejection issued Feb. 23, 2005 by the United States Patent and Trademark Office. pp. 1-10.
U.S. Appl. No. 10/731,874, Final Rejection issued Jun. 28, 2005 by the United States Patent and Trademark Office. pp. 1-7.
U.S. Appl. No. 10/731,874, Examiner's search and strategy results issued Sep. 26, 2005. 1 page.
U.S. Appl. No. 10/731,874, Notice of Allowance of Fees Due, Issue Information, Index of Claims and Search information issued Sep. 29, 2005 by the United States Patent and Trademark Office. 7 pages.
U.S. Appl. No. 10/731,874, Notice of Allowance of Fees Dues, List of References, Issue Information, Search information and index of claims issued Jan. 18, 2006 by the United States Patent and Trademark Office. 10 pages.
U.S. Appl. No. 10/731,874, Non-Final Rejection issued Oct. 13, 2006 by the United States Patent and Trademark Office. 22 pages.

U.S. Appl. No. 10/731,874, Non-Final Rejection issued Apr. 6, 2007 by the United States Patent and Trademark Office. 14 pages.
U.S. Appl. No. 10/731,874, Requirement for Restriction/Election, List of References and index of claims issued Sep. 6, 2007 by the United States Patent and Trademark Office, 20 pages.
U.S. Appl. No. 10/731,874, Examiner's search strategy and results issued Dec. 5, 2007, 1 page.
U.S. Appl. No. 10/731,874, Non-Final Rejection issued Dec. 11, 2007 by the United States Patent and Trademark Office, 22 pages.
U.S. Appl. No. 10/997,834, Examiner's search strategy and results issued Jun. 22, 2005, 5 pages.
U.S. Appl. No. 10/997,834, Non-Final Rejection issued Jul. 6, 2005 by the United States Patent and Trademark Office, 44 pages.
U.S. Appl. No. 10/997,834, Examiner's search strategy and results issued Sep. 26, 2005, 1 page.
U.S. Appl. No. 10/997,834, Notice of Allowance and Fees, Issue Information, Index of Claims and search information issued Sep. 29, 2005 by the United States Patent and Trademark Office, 8 pages.
U.S. Appl. No. 10/411,849, Examiner's search strategy and results issued Aug. 4, 2005, 5 pages.
U.S. Appl. No. 10/411,849, Non-Final Rejection issued Aug. 9, 2005 by the United States Patent and Trademark Office, 8 pages.
U.S. Appl. No. 10/411,849, Non-Final Rejection issued Feb. 8, 2006 by the United States Patent and Trademark Office, 7 pages.
U.S. Appl. No. 10/411,849, Examiner's search strategy and results issued Jul. 18, 2006, 1 page.
U.S. Appl. No. 10/411,849, Notice of Allowance and Fees Due, Examiner Interview Summary Record, Issue Information, Index of Claims, Search Information and Bibliographic Data Sheet issued Jul. 24, 2006 by the United States Patent and Trademark Office, 14 pages.
U.S. Appl. No. 10/997,234, Examiner's search strategy and results issued Mar. 14, 2006, 3 pages.
U.S. Appl. No. 10/997,234, Non-Final Rejection issued Mar. 20, 2006 by the United States Patent and Trademark Office, 13 pages.
U.S. Appl. No. 10/997,234, Examiner's search strategy and results issued Aug. 4, 2006, 1 page.
U.S. Appl. No. 10/997,234, Notice of Allowance and Fees Due, Issue Information, Bibliographic Data Sheet, Index of Claims and Search Information issued Aug. 10, 2006 by the United States Patent and Trademark Office, 8 pages.
U.S. Appl. No. 10/412,628, Non-Final Rejection issued Feb. 16, 2007 by the United States Patent and Trademark Office, 17 pages.
U.S. Appl. No. 10/412,628, Notice of Allowance and Fees Due, Bibliographic Data Sheet, Index of Claims, Search Information and Issue Information issued Aug. 24, 2007 by the United States Patent and Trademark Office, 11 pages.
U.S. Appl. No. 10/873,022, Non-Final Rejection issued Jul. 7, 2005 by the United States Patent and Trademark Office, 12 pages.
U.S. Appl. No. 10/873,022, Notice of Allowance and Fees Due, Specification and Issue Information issued Jan. 4, 2006 by the United States Patent and Trademark Office, 9 pages.
U.S. Appl. No. 10/274,280, Examiner's search strategy and results issued Mar. 14, 2004, 2 pages.
U.S. Appl. No. 10/274,280, Non-Final Rejection issued Mar. 25, 2004 by the United States Patent and Trademark Office, 10 pages.
U.S. Appl. No. 10/274,280, Notice of Allowance and Fees Due, Issue Information and Bibliographic Data Sheet issued Oct. 5, 2004 by the United States Patent and Trademark Office, 8 pages.
U.S. Appl. No. 10/442,673, Examiner's search strategy and results issued Aug. 26, 2004, 2 pages.
U.S. Appl. No. 10/442,673, Non-Final Rejection issued Sep. 1, 2004 by the United States Patent and Trademark Office; 10 pages.
U.S. Appl. No. 10/442,673, Final Rejection issued Feb. 23, 2005 by the United States Patent and Trademark Office; 6 pages.
U.S. Appl. No. 10/442,673, Notice of Allowance and Fees Due, Amendment After Final, Issue Information, Index of Claims and Search Information issued Apr. 20, 2005 by the United States Patent and Trademark Office; 10 pages.
J. J. Kelley, "Applied Artificial Intelligence for Delayed Coking", Hydrocarbon Processing, Nov. 2000, 144-A-144-J, Gulf Publishing Company, USA.
Claudio Allevato & Richard S. Boswell, "Assessing the Structural Integrity and Remaining Life of Coke Drums with Acoustic Emission Testing, Stain Gaging, and Finite Element Analysis," ETCE 99—Symposium on Plant and Facilities Reliability and Mechanical Integrity, 1999 Engineering Source Technology Conference & Exhibition, Stress Engineering Services, Inc.
Paul J. Ellis & Christopher A. Paul, "Tutorial: Delayed Coking Fundamentals,"AIChE 1998 Spring National Meeting's International Conference on Refinery Processes Topical Conference Preprints 1998, 1998, Great Lakes Carbon Corporation.

* cited by examiner

VALVE BODY AND CONDENSATE HOLDING TANK FLUSHING SYSTEMS AND METHODS

RELATED APPLICATIONS

This application claims priority to U.S. Provisional Patent Application Ser. No. 60/780,926, filed Mar. 9, 2006, entitled "Valve Body and Condensate Hodling Tank Flushing System and Methods."

BACKGROUND

1. Field of the Invention

The present invention relates to valve body and condensate holding tank systems and methods for use in delayed coker unit operations. In particular, the present invention relates to allowing accumulated condensate and particulate matter in a valve body or in a condensate holding tank to be flushed into a coker pit by water or other solvent.

2. Background

Petroleum refining operations in which crude oil is processed frequently produce residual oils. Many oil refineries recover valuable products from the heavy residual hydrocarbons. Residual oil, when processed in a delayed coker is heated in a furnace to a temperature sufficient to cause destructive distillation in which a substantial portion of the residual oil is converted, or "cracked" to usable hydrocarbon products and the remainder yields petroleum coke, a material composed mostly of carbon.

Generally, the delayed coking process involves heating the heavy hydrocarbon feed from a fractionation unit, then pumping the heated heavy feed into a large steel vessel commonly known as a coke drum. The unvaporized portion of the heated heavy feed settles out in the coke drum, where the combined effect of retention time and temperature causes the formation of coke. Vapors from the top of the coke vessel are returned to the base of the fractionation unit for further processing into desired light hydrocarbon products. Normal operating pressures in coke drums typically range from twenty-five to fifty p.s.i, and the feed input temperature may vary between 800° F. and 1000° F.

The structural size and shape of the coke drum varies considerably from one installation to another. Coke drums are generally large, upright, cylindrical, metal vessel ninety to one-hundred feet in height, and twenty to thirty feet in diameter. Coke drums have a top head and a bottom portion fitted with a bottom head. Coke drums are usually present in pairs so that they can be operated alternately. Coke settles out and accumulates in a vessel until it is filled, at which time the heated feed is switched to the alternate empty coke drum. While one coke drum is being filled with heated residual oil, the other vessel is being cooled and purged of coke.

Coke removal, also known as decoking, begins with a quench step in which steam and then water are introduced into the coke filled vessel to complete the recovery of volatile, light hydrocarbons and to cool the mass of coke. After a coke drum has been filled, stripped and then quenched so that the coke is in a solid state and the temperature is reduced to a reasonable level, quench water is drained from the drum through piping to allow for safe unheading of the drum. The drum is then vented to atmospheric pressure when the bottom opening is unheaded, to permit removing coke. Once the unheading is complete, the coke in the drum is cut out of the drum by high pressure water jets.

During the unheading and decoking process, the bottom deheader unit is often pressurized by steam and exposed to liquid and solid particular matter falling from the coke drum.

Accordingly, the art of decoking a coke drum may be improved by developing a bottom deheading unit which has the ability to drain excess condensate from steam and to be flushed of any solid particulate matter which accumulates.

SUMMARY

The present invention relates to systems and methods for flushing condensate and particulate matter from a valve body or condensate holding tank in a delayed coker unit operation. Some embodiments comprise fluid preferably water inlet lines, which allow fluid to be flushed into a valve body and/or into a condensate holding tank.

Some embodiments may comprise a coke drum, a fluid inlet line to a deheading body; a shut off valve for the fluid inlet line to the deheading body; a fluid inlet line to a condensate holding tank; a shut off valve to the fluid inlet line to the condensate holding tank; a condensate inlet valve running between the valve body and the condensate holding tank; a shut off valve between the valve body and the condensate holding tank and the condensate inlet line; a valve body; and a condensate holding tank and a chute to a coke pit.

Some embodiments comprise a method for flushing excess condensate and particulate matter from the valve body; and/or from the condensate holding tank. Preferred embodiments for flushing the valve body comprise shutting off the flow of steam into the valve body; opening the valve from the valve body to the condensate holding tank; opening the valve on the fluid inlet line to the valve body; allowing fluid to flow through the valve body; and flushing fluid through the valve body into the condensate inlet line through the condensate holding tank into a chute which empties into a coke pit.

Some embodiments for flushing the condensate holding tank preferably comprise closing the shut off valve in the condensate inlet line; opening the valve in the fluid inlet line; and allowing fluid to flow from the fluid inlet line into the condensate holding tank through a drain into a chute which connects to a coke pit.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

Figure 1:
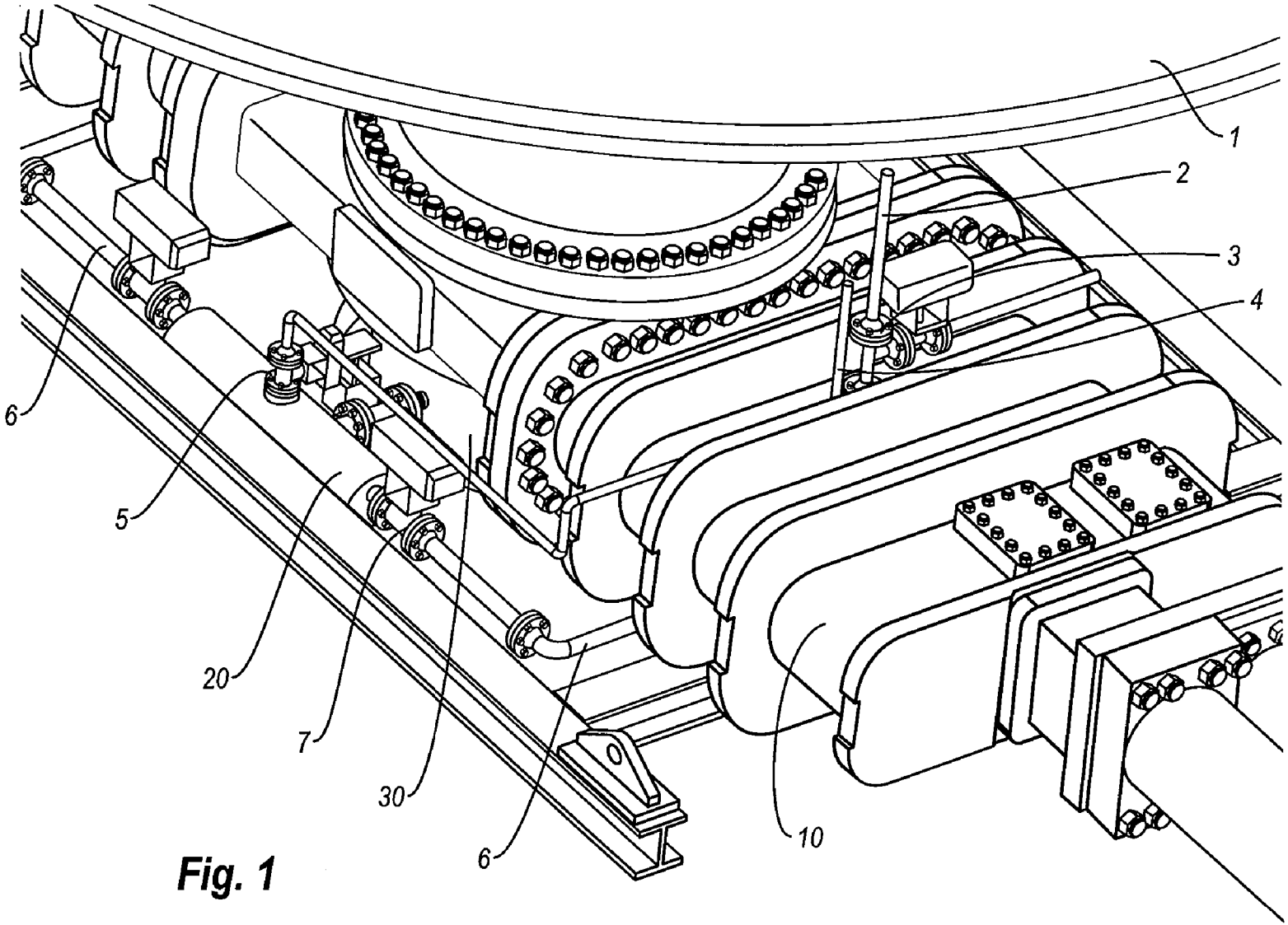
FIG. 1 illustrates an embodiment of some of the valve body and condensate holding tank flushing system.
Figure 2:
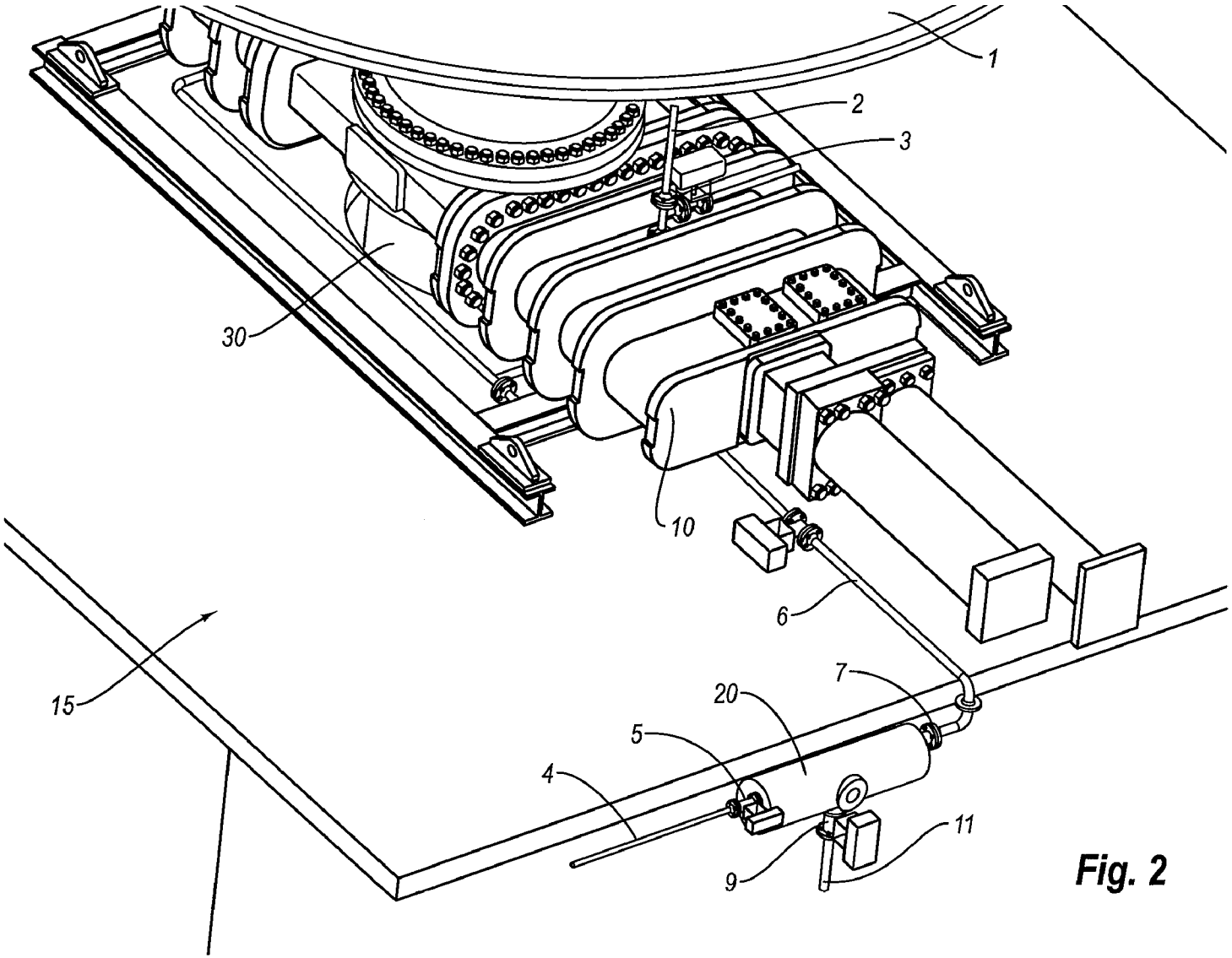
FIG. 2 illustrate an alternative embodiment of the flushing systems of the present invention.
Figure 3:
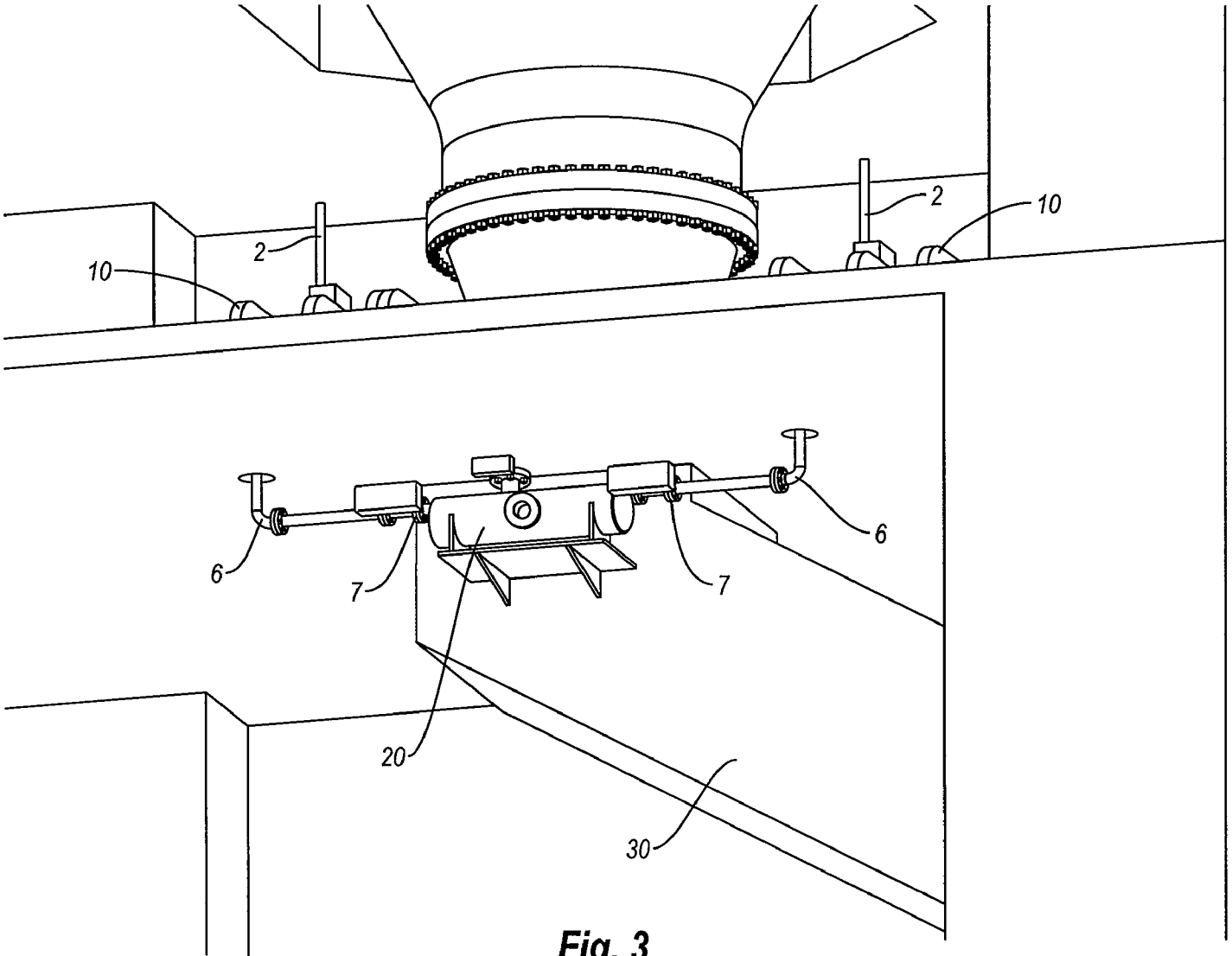
FIG. 3 illustrates a view of an alternate embodiment of the present invention from below the deck.

It will be readily understood that the components of the present invention, as generally described and illustrated in the figures herein, could be arranged and designed in a wide variety of different configurations. Thus, the following more detailed description of the embodiments of the system, device, and method of the present invention, as represented in FIGS. 1-3, is not intended to limit the scope of the invention, as claimed, but is merely representative of some of the embodiments of the invention.

Embodiments of the invention will be best understood by reference to the drawings wherein like parts are designated by like numerals throughout. Although reference to the drawings and a corresponding discussion follow below, the following more detailed description is divided into sections. The first section pertains to and sets forth a general discussion of the delayed coking process. The second section pertains to and sets forth the vibration monitoring system that may be utilized in the delayed coking process, as well as the various methods for utilizing the system within a delayed coking or other similar environment. It is noted that these sections are not intended to be limiting in any way, but are simply provided as convenience to the reader.

1. General Discussion on the Delayed Coking Process

In the typical delayed coking process, high boiling petroleum residues are fed to one or more coke drums where they are thermally cracked into light products and a solid residue-petroleum coke. Coke drums are typically large cylindrical vessels having a top head and a conical bottom portion fitted with a bottom head. The fundamental goal of coking is the thermal cracking of very high boiling point petroleum residues into lighter fuel fractions. Coke is a byproduct of the process. Delayed coking is an endothermic reaction with a furnace supplying the necessary heat to complete the coking reaction in a drum. The exact mechanism is very complex, and out of all the reactions that occur, only three distinct steps have been isolated: 1) partial vaporization and mild coking of the feed as it passes through the furnace; 2) cracking of the vapor as it passes through the coke drum; and 3) cracking and polymerization of the heavy liquid trapped in the drum until it is converted to vapor and coke. The process is extremely temperature-sensitive with the varying temperatures producing varying types of coke. For example, if the temperature is too low, the coking reaction does not proceed far enough and pitch or soft coke formation occurs. If the temperature is too high, the coke formed generally is very hard and difficult to remove from the drum with hydraulic decoking equipment. Higher temperatures also increase the risk of coking in the furnace tubes or the transfer line. As stated, delayed coking is a thermal cracking process used in petroleum refineries to upgrade and convert petroleum residuum into liquid and gas product streams leaving behind a solid concentrated carbon material, or coke. A furnace is used in the process to reach thermal cracking temperatures, which range upwards of 1,000° F. With short residence time in the furnace, coking of the feed material is thereby "delayed" until it reaches large coking drums downstream of the heater. In normal operations, there are two coke drums so that when one is being filled, the other may be purged of the manufactured coke.

In a typical petroleum refinery process, several different physical structures of petroleum coke may be produced. These are namely, shot coke, sponge coke, and/or needle coke (hereinafter collectively referred to as "coke"), and are each distinguished by their physical structures and chemical properties. These physical structures and chemical properties also serve to determine the end use of the material. Several uses are available for manufactured coke, some of which include fuel for burning, the ability to be calcined for use in the aluminum, chemical, or steel industries, or the ability to be gasified to produce steam, electricity, or gas feedstock for the petrochemicals industry.

To produce the coke, a delayed coker feed originates from the crude oil supplied to the refinery and travels through a series of process members and finally empties into one of the coke drums used to manufacture coke. A basic refinery flow diagram is presented as FIG. 4, with two coke drums shown.

The delayed coking process typically comprises a batch-continuous process, which means that the process is ongoing or continuous as the feed stream coming from the furnace alternates filling between the two or more coke drums. As mentioned, while one drum is on-line filling up with coke, the other is being stripped, cooled, decoked, and prepared to receive another batch. In the past, this has proven to be an extremely time and labor intensive process, with each batch in the batch-continuous process taking approximately 12-20 hours to complete. In essence, hot oil, or resid as it is commonly referred to, from the tube furnace is fed into one of the coke drums in the system. The oil is extremely hot and produces hot vapors that condense on the colder walls of the coke drum. As the drum is being filled, a large amount of liquid runs down the sides of the drum into a boiling turbulent pool at the bottom. As this process continues, the hot resid and the condensing vapors cause the coke drum walls to heat. This naturally in turn, causes the resid to produce less and less of the condensing vapors, which ultimately causes the liquid at the bottom of the coke drum to start to heat up to coking temperatures. After some time, a main channel is formed in the coke drum, and as time goes on, the liquid above the accumulated coke decreases and the liquid turns to a more viscous type tar. This tar keeps trying to run back down the main channel which can coke at the top, thus causing the channel to branch. This process progresses up through the coke drum until the drum is full, wherein the liquid pools slowly turn to solid coke. When the first coke drum is full, the hot oil feed is switched to the second coke drum, and the first coke drum is isolated, steamed to remove residual hydrocarbons, cooled by filling with water, opened, and then decoked. This cyclical process is repeated over and over again throughout the manufacture of coke. The decoking process is the process used to remove the coke from the drum upon completion of the coking process. Due to the shape of the coke drum, coke accumulates in the area near and attaches to the flanges or other members used to close off the opening of the coke drum during the manufacturing process. In the case of a flanged system, once full, the bottom of the coke drum is vented and opened to atmospheric pressure through a large valve and the top flange (typically a 4-foot diameter flange) is also vented and opened to enable insertion of a hydraulic coke cutting apparatus into the drum through the top. After the cooling water is drained out the bottom of the vessel through the bottom valve, coke removal being by drilling a pilot hole from top to bottom of the coke bed using high pressure water jets. Following this, the main body of coke left in the coke drum is cut into fragments which fall out the bottom and into a collection bin or pit.

As the bottom valve is opening, some contaminated steam from inside the still partially pressurized drum may pass into the body of the opening valve. Although most bottom deheading systems are not exposed internally to this steam when completely opened or closed, some valves do experience infiltration of contaminated stem while partially opened or closed. Any debris introduced into the valve internal by the steam, typically falls to the bottom of the bonnet portion of the valve as the steam condenses. Steam concentrate is trapped at the bottom of the bonnet or lower valve internals. Since this area is typically still pressurized, this condensate is not allowed to escape but is held until the valve body is depressurized for maintenance and is then drained into the pit. Unfortunately, debris may clod the drain hole preventing draining.

2. Flushing System

Although the present invention is intended to cover the use of flushing systems in delayed coker unit systems or rather the devices of the present invention may be used to clear debris from the drain area as well as cleaning or flushing the inside of the bonnet.

The present invention describes various embodiments of a valve body condensate holding tank flushing system, and methods for using the same. As depicted in FIG. 1, reference character 1 denotes a coke drum that is connected to a valve body 10. The valve body 10 depicted in FIG. 1 is a bottom deheader unit, which allows a coke drum to be selectively opened and closed during the decoking process. As depicted in FIG. 1 the body of the valve 10 is connected to a chute 30 which allows coke and all of the debris to be directed into the collection bin or pit below.

In some embodiments, the valve body 10 contains pressurized steam, which is fed into the valve body 10 by a steam line. As steam cools inside the valve body 10 condensate is allowed to flow from the valve body 10 into a condensate holding tank 20. In most utilized valve body systems, because the body of the valve 10 is under pressure, the condensate holding 20 tank must be a closed system. That is the drain, (not depicted) leading from the condensate holding tank 20 to the chute 30 is separated by a valve which allows the condensate holding tank 20 to remain at pressure. This allows the valve body 10 to remain pressurized.

In some embodiments, when the condensate holding tank 20 has filled to capacity with condensation or debris, e.g. byproducts of the decoking operation, the shut off valve 7 in the condensation inlet line may be closed allowing the body of the valve 10 to maintain steam pressure while the drain connecting the condensate holding tank 20 to the chute 30 is opened, allowing the full condensate holding tank 20 to empty its contents into a chute 30. Accordingly, in some embodiments the condensate holding tank 20 may be emptied of its contents during continuous use of the deheading valve.

In some embodiments, the valve body 10 may also be flushed of any excess condensation or debris. In a non-limiting example, during the delayed coker operation coke or other material flowing from the coke drum 1 through the valve body 10 into the chute 30 and into the coke pit, may leak into the valve body 10 itself, and overtime build up a substantial residue, which may impair the functionality of the valve. This may cause the valve to have diminished sealing capabilities. Accordingly, it is desirable to utilize a system which actively prevents the flow of materials from the coke drum 1 into the valve body 10, in order to protect the moving parts of the valve. Additionally, it is desirable to develop systems which allow the continued operation of a valve despite some leakage of material into the valve body 10. In some prior art systems, and in preferred embodiments of the present invention, the valve body 10 is pressurized by a steam system which prevents the flow of material from the coke drum 1 into the valve body 10. Accordingly, some systems exist already that are designed to prevent the flow of contaminants or debris into the valve body 10

Some embodiments of the present invention provide the significant advantage of allowing the valve body 10 to be flushed of any debris which accumulates into the valve body 10. Some embodiments of the flush system comprise a valve body 10, a fluid inlet line 2 to the deheader body 10, a shut off valve for a fluid inlet line 3 to the valve body 10. Accordingly, in some embodiments once a valve has accumulated a significant amount of debris, the high pressure steam inlet may be shut off, and the shut off valve for the fluid inlet line 3 may be opened allowing the fluid to flow from the fluid inlet line 2 into the valve body 10, effectively flushing any debris or, residual materials from the valve body 10. This cleans the internal components of the valve body 10. The fluid flushed into the system from the fluid inlet line 2 through the valve body 10 is allowed to drain through the condensation inlet line 6, and subsequently into the condensation holding tank 20 where it may be held for a period of time or allowed to flow directly into the chute 30 and coke pit.

Some embodiments allow for a valve body 10 and condensate holding tank 20 to be cleared of debris or excess condensation. Once the flushing of the valve body 10 is complete, the fluid inlet line 2 to the valve body 10 may be shut off at the shut off valve 3 and the steam pressure turned on repressurizing the body of the valve 10 again. This may be done to prevent the flow of material from the coke drum into the moving parts of the valve body 10.

FIG. 2 depicts an alternative embodiment of the present invention. In particular, FIG. 2 depicts a system wherein the condensate holding tank 20 exists below the deck 15. This configuration may be employed for various reasons. In a non-limiting example, the depicted embodiment may be utilized in a deheader operation where there is insufficient space above the deck to retain the condensate holding tank 20. In another non-limiting example, a condensate holding tank 20 may be installed below the deck 15 to allow the flushing system to be integrated into existing decoker installation, which would otherwise not have flushing capacities. Accordingly, embodiments of the present invention may be designed to be installed with new systems or may be used to retrofit existing deheader operations.

As depicted in FIG. 2, condensation holding tank 20 is located below the deck 15 and may be utilized in a manner significantly similar to previously discussed embodiments, wherein the condensate holding tank 20 exists above the deck 15. As depicted in FIG. 2, the condensate holding tank 20 may be drained of its excess condensate at any time during the operation of the delayed coker unit by turning off the shut off valve 7, maintaining the closed system of the valve body 10, allowing pressurized steam to be maintained the valve body 10 to prevent the flow of residual materials from the coker drum 1 into the valve body 10. Once the shut off valve 7 has been closed, the drain 9 exiting from the condensate holding tank 20 may be opened. The drain 9 and drain pipe 11 allow the condensate and debris accumulated in the condensate holding tank 20 to be drained from the condensate holding tank 20 into a chute 30 (not depicted in FIG. 2) which leads to the pit. Once the condensate holding tank 20 is drained, the drain shut off valve 9 may be closed for the shut off valve and the condensate inlet line 7 may be opened allowing the valve body 10 to remain pressurized and continue to drain condensate and debris into the condensate holding tank. Accordingly, some embodiments of the invention provide the opportunity to purge the condensate holding tank 20 at any time, even during active operation of the deheader unit.

As depicted in FIG. 2, the valve body may also be purged of debris and fluids. As depicted in FIG. 2, the valve body 10 may be drained and flushed clean. In some embodiments, to flush the valve body 10, as depicted in FIG. 2, the steam inlet line to the valve body may be closed terminating the flow of pressurized steam into the valve body 10. Subsequently the shut off valve for the fluid inlet line 3 may be opened, allowing fluid to flow from the inlet line 2 into the valve body 10. As described above, flushing the debris and materials from the interior of the valve body 10 effectively cleans the interior of the valve body 10 while the valve body 10 remains in place. Once the valve body has been sufficiently purged of debris, the fluid inlet line 2 to the deheading valve may be shut off by of the shut off valve 3 ceasing the flow of fluid into the valve body 10, and the steam inlet line reopened repressurizing the interior of the valve body 10. This allows the valve body to continue its normal operations.

As described above, the debris and fluid allowed to flow into the valve body 10 from the fluid inlet line 2 may flow into the condensate inlet line 6 and subsequently into the condensate holding tank 20 and be immediately drained into the chute/coke pit 30 or retained for a period of time in the condensate holding tank to be released later.

FIG. 3 depicts an alternative embodiment wherein the condensate holding tank is located below the deck 15. As depicted in FIG. 3, the condensate holding tank is located in between the two bonnets of the valve body 10. Accordingly, when condensate drains from the valve body 10 during the normal course of operation, the condensate is allowed to flow through the condensate inlet line 6 and into the condensate holding tank 20. During the normal course of operation, the drain 9 (not depicted in FIG. 3) and drain pipe 11 leading to the chute 30 and coke pit 30, is closed to maintain a closed system allowing the valve body 10 to maintain a pressurized state. This prevents the flow of debris and other materials from the coke drum 1 into the valve body 10.

As described above, the condensate holding tank 20 may be drained of its contents by closing the condensate inlet line shut off valves 7 and opening the drain 9 allowing the excess condensate and debris in the condensate holding tank 20 to drain into a pipe 11 which leads to the chute and coke pit 30. Accordingly, the condensate holding tank 20 may be emptied during operation of the valve without depressurizing the valve body 10. Once the condensate holding tank 20 has expelled the excess condensate and debris, the drain 9 may be closed. Thereafter, the shut off valve from the condensate inlet line 6 may be opened allowing condensate and debris generated in the valve body 10 to drain to the condensate holding tank 20.

As depicted in FIG. 3, the valve body 10 may also be flushed of any contaminants or accumulated debris by shutting off the pressurized steam inlet lines, and opening the fluid inlet lines 2 to allow fluid to flow through the valve body 10, flushing any debris or materials from the valve body 10 through the condensate inlet line 6 and into the condensate holding tank 20 to be immediately drained into the chute and coke pit, or retained in the condensate holding tank 20 for the desired period of time. Once flushed of debris and extraneous materials, the fluid inlet lines 2 to the valve body 10 may be shut off, and the pressurized steam inlets into the valve body 10 open to allow the valve body 10 to repressurize, preventing the flow of contaminants and debris from the coke drum 1 into the valve body 10 itself.

What is claimed:

1. A device for collecting condensate which drains from a valve body in a de-coker operation comprising:

a liquid solvent source;

a valve body;

a shut off valve to control the flow of solvent into the valve body;

a drain valve to control the flow of liquid from the valve body; and a condensate holding tank.

2. The device of claim 1, wherein the solvent is water.

3. The device of claim 1, further comprising a steam inlet line, coupled to said valve body wherein said line allows high pressure steam to enter the valve body.

4. The device of claim 3, wherein said steam inlet line comprises a shutoff valve.

5. The device of claim 4, wherein said steam shutoff valve is opened during normal operation to pressurize said valve body.

6. The device of claim 1, wherein the condensate holding tank is fluidly connected to a coke chute and said valve body.

7. The device of claim 6, wherein the condensate holding tank further comprises a drain valve to control the flow of fluid between the condensate holding tank and the coke chute.

8. The device of claim 7, wherein said condensate holding tank drain valve is open during normal valve operation to allow condensation and debris to flow from the condensate holding tank into said coke chute.

9. The device of claim 1, wherein said holding tank exists below a deck.

10. The device of claim 1, wherein the condensate holding tank further comprises an inlet valve to control the flow of fluid and debris between the valve body and the condensate holding tank.

11. The device of claim 1, wherein said condensate holding tank further comprising a fluid inlet line, wherein said fluid inlet line allows fluid to flush debris and condensation from the condensate holding tank.

12. The device of claim 11, further comprising a shut off valve connected to the fluid inlet line for the condensate holding tank.

13. The device of claim 1, further comprising a coke drum removeably connected to said valve body.

14. A method of flushing debris from a pressurized decoking valve body comprising the steps of:

opening a valve to allow entry of-fluid into a valve body to flush debris from the valve body with said fluid;

allowing said fluid and any accumulated debris to drain from the valve body through an exit control valve; and allowing the fluid and accumulated debris to flow through the exit control valve into a condensate holding tank.

15. The method of claim 14, further comprising an initial step of shutting off a flow of steam into the valve body.

16. The device of claim 15, further comprising the step of opening a steam inlet line to allow steam to flow into the valve body, after allowing fluid and accumulated debris to drain from the valve body.

17. The method of claim 14, further comprising the step of fluidly connecting the condensate holding tank to a coke chute.

18. The method of claim 14, further comprising the additional step of shutting off a valve connecting a fluid inlet line for the condensate holding tank.

19. The method of claim 14, further comprising the step of opening a valve located between the condensate holding tank and a coke pit chute allowing said fluid and debris to flow from the holding tank into said coke pit chute.

20. The method of claim 14, further comprising the step of removeably connecting said valve body to a coke drum.

21. A method of flushing debris from a pressurized decoking valve body comprising the steps of shutting off a high pressure steam inlet valve;

opening a fluid inlet line shut off valve, allowing fluid to flow from the fluid inlet line into the valve body;

flushing debris and residual materials from the valve body;

allowing fluid flushed from the fluid inlet line through the valve body to drain through a condensation inlet line;

allowing said fluid to flow from said condensation inlet line to a condensation holding tank;

holding said fluid and debris for a period of time in said condensation holding tank; and allowing said fluid and debris in said condensation holding tank to flow into a coke pit.

22. A device for collecting condensate which drains from a valve body in a decoker operation comprising:

a liquid solvent source;

a valve body;

a shut off valve to control the flow of solvent into the valve body;

a drain valve to control the flow of liquid from the valve body; and a coke drum removeably connected to said valve body.

23. The device of claim 22, wherein the solvent is water.

24. The device of claim 22, further comprising a steam inlet line, coupled to said valve body wherein said line allows high pressure steam to enter the valve body.

25. The device of claim 24, wherein said steam inlet line comprises a shutoff valve.

26. The device of claim 25, wherein said steam shutoff valve is opened during normal operation to pressurize said valve body.

27. The device of claim 22, further comprising a condensate holding tank.

28. The device of claim 22, wherein the condensate holding tank is fluidly connected to a coke chute and said valve body.

29. The device of claim 28, wherein the condensate holding tank further comprises a drain valve to control the flow of fluid between the condensate holding tank and the coke chute.

30. The device of claim 28, wherein said condensate holding tank drain valve is open during normal valve operation to allow condensation and debris to flow from the condensate holding tank into said coke chute.

31. The device of claim 27, wherein said holding tank exists below a deck.

32. The device of claim 27, wherein the condensate holding tank further comprises an inlet valve to control the flow of fluid and debris between the valve body and the condensate holding tank.

33. The device of claim 27, wherein said condensate holding tank further comprising a fluid inlet line, wherein said fluid inlet line allows fluid to flush debris and condensation from the condensate holding tank.

34. The device of claim 33, further comprising a shut off valve connected to the fluid inlet line for the condensate holding tank.

35. A method of flushing debris from a pressurized decoking valve body comprising the steps of:

opening a valve to allow entry of-fluid into a valve body to flush debris from the valve body with said fluid;

allowing said fluid and any accumulated debris to drain from the valve body through an exit control valve; and removeably connecting said valve body to a coke drum.

36. The method of claim 35, further comprising an initial step of shutting off a flow of steam into the valve body.

37. The device of claim 36, further comprising the step of opening a steam inlet line to allow steam to flow into the valve body, after allowing fluid and accumulated debris to drain from the valve body.

38. The method of claim 35, further comprising allowing the fluid and accumulated debris to flow through the exit control valve into a condensate holding tank.

39. The method of claim 38, further comprising the step of fluidly connecting the condensate holding tank to a coke chute.

40. The method of claim 38, further comprising the additional step of shutting off a valve connecting a fluid inlet line for the condensate holding tank.

41. The method of claim 38, further comprising the step of opening a valve located between the condensate holding tank and a coke pit chute allowing said fluid and debris to flow from the holding tank into said coke pit chute.

* * * * *